US005772449A

United States Patent [19]

Feldmeier et al.

[11] Patent Number: 5,772,449

[45] Date of Patent: Jun. 30, 1998

[54] ELECTRICAL INSTALLATION BUS CONNECTOR

[75] Inventors: Günter Feldmeier, Lorsch; Manfred Schaarschmidt, Bensheim, both of Germany

[73] Assignee: The Whitaker Corporation, Wilmington, Del.

[21] Appl. No.: 938,498

[22] Filed: Sep. 26, 1997

Related U.S. Application Data

[63] Continuation of Ser. No. 709,458, Sep. 5, 1996, abandoned.

[30] Foreign Application Priority Data

Sep. 20, 1995 [GB] United Kingdom ..... 9519204

[51] Int. Cl.[6] ..... H01R 23/72

[52] U.S. Cl. ..... 439/66; 439/65; 439/626; 439/289

[58] Field of Search ..... 439/65, 66, 71, 439/289, 626, 629

[56] References Cited

U.S. PATENT DOCUMENTS

| | | | |
|---|---|---|---|
| 2,956,141 | 10/1960 | Smith | 439/65 |
| 3,215,968 | 11/1965 | Hearmann | 439/629 |
| 4,341,433 | 7/1982 | Cherian et al. | 439/71 |
| 4,725,250 | 2/1988 | Kuhn et al. | 439/629 |
| 4,927,369 | 5/1990 | Grabbe et al. | 439/66 |
| 5,098,306 | 3/1992 | Noschese et al. | 439/92 |

FOREIGN PATENT DOCUMENTS

| | | | |
|---|---|---|---|
| 0 546 679 A1 | 6/1993 | European Pat. Off. | H05K 7/10 |
| 9410349 | 6/1994 | Germany . | |
| 0012267 | 4/1972 | Japan | 439/629 |
| 1400605 | 7/1975 | United Kingdom | 439/92 |

*Primary Examiner*—J. J. Swann
*Attorney, Agent, or Firm*—Driscoll A. Nina; Anton P. Ness

[57] ABSTRACT

A connector for connection to bus conductors comprises terminals that have a pair of contact sections mounted on supple springs. The contact sections are for biasing against exposed conductors of a bus line. The redundancy provided by the two remotely spaced contact sections ensures high connection reliability, in particular in view of the exposure of the bus line conductors to dirt or damage to the contact surface.

6 Claims, 2 Drawing Sheets

ELECTRICAL INSTALLATION BUS CONNECTOR

This application is a Continuation of application Ser. No. 08/709,458 filed Sep. 5, 1996, now abandoned.

BACKGROUND OF THE INVENTION

1. Field of the Invention

This invention relates to an electrical connector for a bus line conductor.

2. Description of the Prior Art

Bus line conductors are generally cables or printed circuit boards (PCBs) with a plurality of electrical conductors mounted in a juxtaposed and parallel manner therealong, the bus line for carrying electrical signals which can be tapped more or less at any position along the bus line. A bus line may be used for transmitting command signals in a building or house, to control various electrical and electronic or communications devices installed in different locations within the building. German Utility Model G9410349.6 discloses a bus line connector having a plurality of planar edge-stamped terminals mounted in a compact juxtaposed manner within an insulative housing, the terminals having arcuate contact portions extending beyond a top surface of the housing and mounted on a long, supple spring section. This connector can be mounted on a pivotable structure with respect to the bus line conductors which are mounted in a railing. The long supple spring enables the contact sections to absorb large tolerances without adversely effecting the contact force. Furthermore, the contact sections are adapted to provide a wiping action upon connection with the bus line conductors. The contact sections cannot be overstressed as they are fully receivable within slots of the connector housing. Although the bus line connector in Utility Model G9410349.6 is particularly cost-effective, compact and in many circumstances reliable, there is a need to further improve the reliability of this connector. A particular problem may arise if dirt is on the contact or on the bus line conductor, or a portion of the bus line conductor (for example if it is a PCB) has a portion of its contact surface missing, then contact between one or more of the terminals of the connector and the bus line may fail. The latter problem is enhanced by the small contact surface between the connector terminals and the bus line conductors, and furthermore by the relatively exposed conductors of the bus line.

SUMMARY OF THE INVENTION

It is therefore an object of this invention to provide an electrical connector for contacting a bus line that is cost-effective and compact, yet has high reliability, in particular ensuring reliable contact between terminals of the connector and the bus line conductors.

Objects of this invention have been achieved by providing an electrical connector for connection to a bus line conductor, the connector comprising an insulative housing and a plurality of terminals mounted therein and having a contact portion projecting beyond an outer surface of the housing, each terminal comprising a pair of contact sections spaced apart from each other, each contact section mounted on a supple spring section. In an advantageous embodiment, the contact sections are arranged in mirror-image disposition with respect to each other. The contact could be stamped and formed from sheet metal having a first major plane from which a first contact extends, and a second major plane adjacent to the first major plane and interconnected thereto via a U-bend, the second major plane supporting the second contact. In an advantageous embodiment, the contacts are offset with respect to their first and second major planes towards a central portion, such that the contact sections are aligned in the same plane. The long supple spring section allows the contact to bias fully into a slot within the insulative housing to prevent damage or overstressing thereof. Free ends of each of the contact sections are bent inwardly and project into the slot of the housing to provide secure lateral guidance to the contact section.

Further advantageous aspects of the invention will be apparent from the following description and the claims.

DETAILED DESCRIPTION OF THE PREFERRED EMBODIMENT

Figure 3:
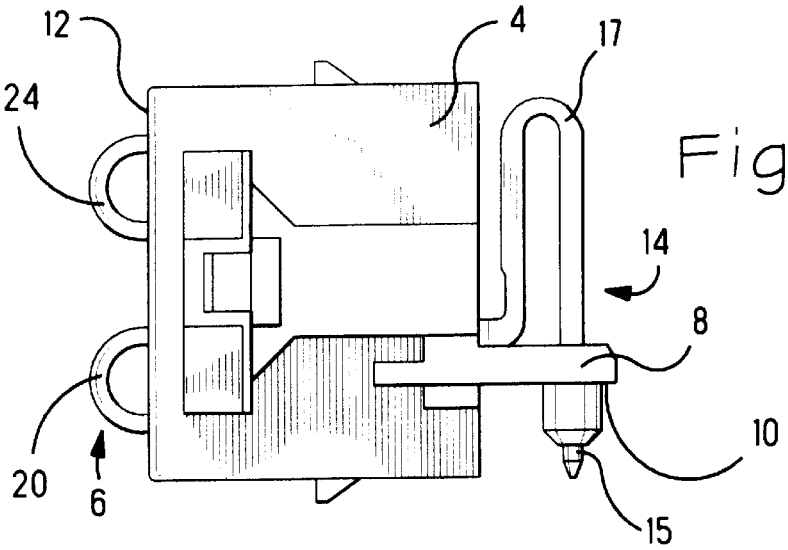
FIG. 3 is a view in the direction of arrow III of FIG. 2.
Figure 2:
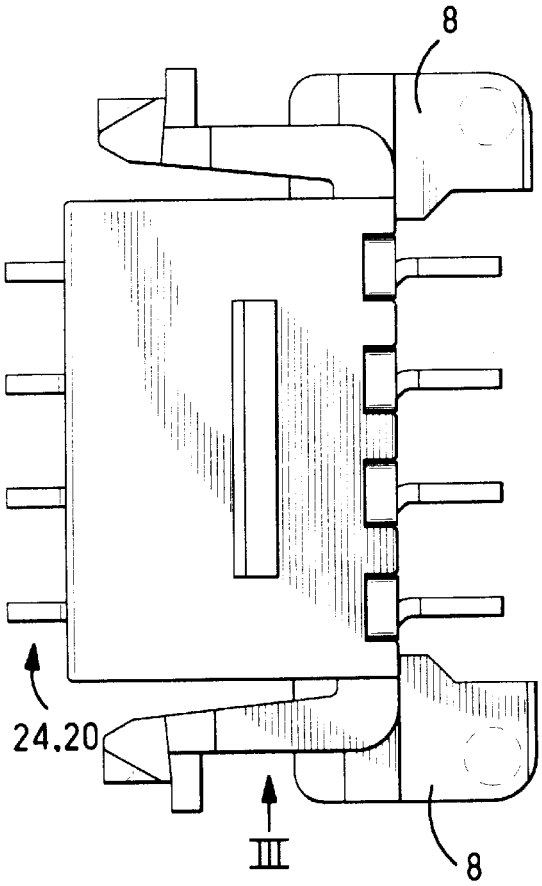
FIG. 2 is a view in the direction of arrow II of FIG. 1.
Figure 1:
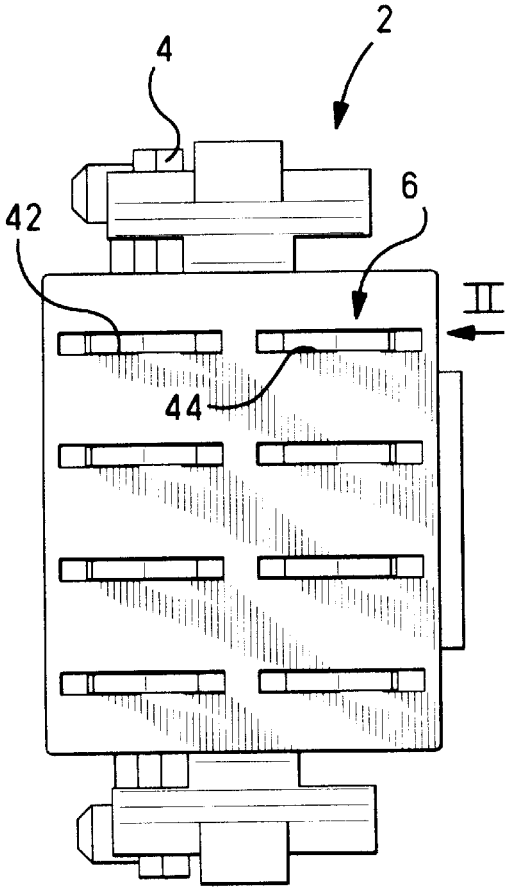
FIG. 1 is a view in the direction of the mating face of an electrical connector according to this invention.

Referring to FIGS. 1–3, an electrical connector 2 comprises an insulative housing 4 and a plurality of terminals 6 stamped and formed from sheet metal and arranged in a juxtaposed manner. The housing 4 has a mounting portion 8 having a mounting face 10 for mounting against a PCB, the housing further comprising a mating face 12 for mounting adjacent a bus line conductor.

Figure 4:
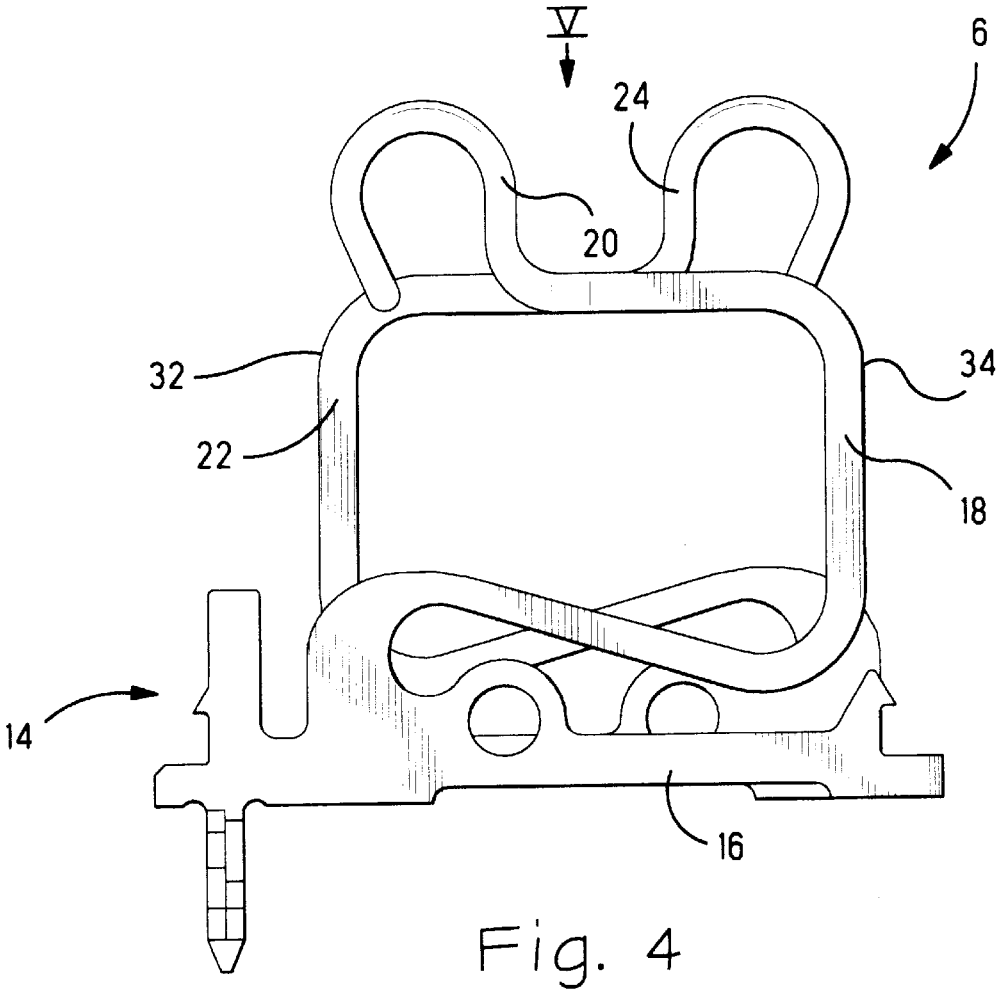
FIG. 4 is a side view of a terminal according to this invention.
Figure 5:
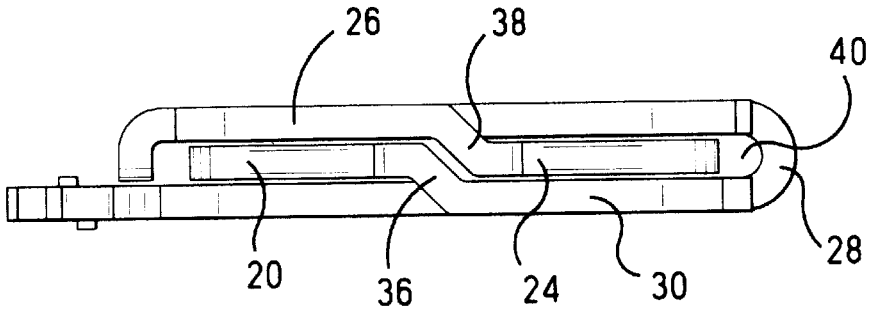
FIG. 5 is a view in the direction of arrow V of FIG. 4.

Referring mainly to FIGS. 4 and 5, the terminal 6 is shown comprising a connection section 14 for connection to a conductor (in this particular embodiment comprising a compliant pin 15 for mounting in a plated hole of a PCB), a base section 16, a first supple spring section 18 and a first contact section 20 extending from the base section 16; further comprising a second supple spring section 22 and second contact section 24 also extending from the base section 16. The terminal of the connector of FIG. 3 is slightly different from the embodiment of FIG. 4, in that it comprises a U-bend portion 17 in the mounting section 14 in order to mount on a PCB (not shown) orthogonally to a connector embodiment comprising the terminals of FIG. 4. The U-bend portion 17 is long and supple and allows some flexible movement of the mounting section 14 for adjustment to tolerances in positioning of the terminals 6 with respect to the housing 4. The base section 16 extends along a first major plane 26 that is attached to the connection section 14, and extends through a U-bend 28 into a second major plane 30. The first supple spring section extends substantially in the first major plane, and the second spring section extends substantially in the second major plane. The spring sections 18,22 are substantially identical, as well as the contact sections 20,24 but are disposed in mirror-image disposition with respect to each other such that the first contact section 20 and the second contact section 24 are remote from each other and positioned proximate opposing ends 32,34 respectively of the terminal 6. Both the first and second contact sections 20,24 are offset via oblique portions 36,38 respectively towards a central plane 40 of the terminal such that the contact sections 20,24 are aligned with each other in the central plane 40. Each conductor of a bus line coupled to the connector 2 is thus contacted at two remote contact points by the corresponding terminal 6 thereby ensuring that dirt, or a defective bus line conductor contact surface that fails one of the contacts, will nevertheless be contacted to the other contact. This redundancy thus greatly increases the reliability of the connector. Each of the contact sections 20,24 projects through a cutout 42,44 respectively through the mating face 12 of the housing. Due to the supple spring sections 18,22 both the contact sections can be fully biased below the mating face into the housing thereby providing protection to the contacts, whereby the supple spring section also enables absorption of large tolerances and mounting of the connector on a hinge or cover support similar to that described in German Utility Model G9410349.6. The substantially planar shapes of the spring and base sections enables a compact terminal to be provided.

Advantageously therefore, additional redundancy in a compact and cost-effective manner ensures provision of a cost-effective connector with high reliability for connection to bus line conductors.

We claim:

1. An electrical connector for connection to an electrical bus line, the connector comprising an insulative housing having an outer mating face and further having a plurality of terminals, each terminal having a base section, first and second spring sections and first and second contact sections extending respectively therefrom, the first and second contact sections protruding beyond a common outer mating face of the housing, and being deflectable into the housing toward the base section upon abutting engagement with the bus line conductor along the outer mating face, when the common outer mating face is abutted against a common bus line conductor associated with the first and second contact sections during mating.

2. The connector of claim 1 wherein the second contact section extends from a supple spring section that extends from the base section.

3. The connector of claim 2 wherein the first and second contact and spring sections are substantially identical in shape but arranged in mirror-image disposition with respect to each other.

4. The connector of claim 2 wherein the first and second supple spring sections extend substantially in first and second major planes respectively that are parallel but spaced apart.

5. The connector of claim 4 wherein the first and second contact sections respectively are offset towards a central plane with respect to the first and second major planes respectively, such that the first and second contact sections are substantially aligned with each other in the central plane.

6. The connector of claim 1 wherein free ends of the first and second contact section are bent inwardly into the cutout of the housing.

* * * * *